US007403196B2

(12) United States Patent
Hattori et al.

(10) Patent No.: US 7,403,196 B2
(45) Date of Patent: Jul. 22, 2008

(54) ORGANIC EL DISPLAY APPARATUS

(75) Inventors: Reiji Hattori, Fukuoka (JP); Hisao Tanabe, Tokyo (JP); Naoki Kobayashi, Tokyo (JP); Yasushi Sato, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 703 days.

(21) Appl. No.: 11/092,606

(22) Filed: Mar. 30, 2005

(65) Prior Publication Data

US 2005/0219167 A1 Oct. 6, 2005

(30) Foreign Application Priority Data

Mar. 31, 2004 (JP) ..... P2004-108129

(51) Int. Cl.
*G09G 3/30* (2006.01)

(52) U.S. Cl. ..... 345/205; 345/77

(58) Field of Classification Search ..... 345/76–83, 345/205

See application file for complete search history.

(56) References Cited

U.S. PATENT DOCUMENTS 6,392,617 B1 * 5/2002 Gleason ..... 345/82
6,396,217 B1 5/2002 Weindorf
6,462,722 B1 10/2002 Kimura et al.
6,522,315 B2 2/2003 Ozawa et al.
6,720,942 B2 * 4/2004 Lee et al. ..... 345/82
6,774,578 B2 8/2004 Tanada
6,839,045 B2 1/2005 Ozawa et al.
6,903,516 B2 6/2005 Tanada
7,180,483 B2 2/2007 Kimura et al.
7,221,339 B2 5/2007 Ozawa et al.
7,253,793 B2 8/2007 Ozawa et al.
7,268,499 B2 9/2007 Tanada
2003/0146371 A1 8/2003 Gudesen et al.
2003/0231273 A1 12/2003 Kimura et al.
2006/0273995 A1 12/2006 Ozawa et al.
2006/0273996 A1 12/2006 Ozawa et al.
2006/0279491 A1 12/2006 Ozawa et al.

FOREIGN PATENT DOCUMENTS

JP 2000-294026 10/2000
JP 2001-85160 3/2001

(Continued)

*Primary Examiner*—Sumati Lefkowitz
*Assistant Examiner*—Ke Xiao
(74) *Attorney, Agent, or Firm*—Finnegan, Henderson, Farabow, Garrett & Dunner, L.L.P.

(57) ABSTRACT

Disclosed is an organic EL display apparatus comprising: a light emitting section; a current control section which controls a current to be flown to the light emitting section; a photoelectric converting section which generates a current upon detecting light emitted from the light emitting section; a first switching section which switches between transmission and non-transmission of the current generated; an amplifying section which performs current-voltage conversion of the current transmitted by the first switching section and amplifies it; a comparison amplifying section which performs comparison and amplification of a voltage value obtained by the amplification and a voltage value corresponding to the image signal; a second switching section which switches between transmission and non-transmission of the voltage value resulting from the comparison and amplification; and an image signal holding capacitor which is charged or discharged according to the voltage value transmitted by the second switching section.

7 Claims, 4 Drawing Sheets

FOREIGN PATENT DOCUMENTS

| | | |
|---|---|---|
| JP | 2002-091377 | 3/2002 |
| JP | 2002-169511 | 6/2002 |
| JP | 2002-287720 | 10/2002 |
| JP | 2003-271098 | 9/2003 |
| JP | 2004-54261 | 2/2004 |
| JP | 2004-93777 | 3/2004 |

* cited by examiner

ORGANIC EL DISPLAY APPARATUS

BACKGROUND

1. Field of the Invention

The present invention relates to an organic EL display apparatus in which a self-emission organic EL (electroluminescence) element is used for each pixel and disposed in a matrix form, and more particularly to an organic EL display apparatus which is suitable for reduction of luminance variation of the individual pixels.

2. Description of the Related Art

The display apparatus using the organic EL elements has features not possessed by an LCD (liquid crystal display apparatus) because the organic EL elements are self-emission elements not requiring a backlight and appropriate for reduction of power consumption. It also has characteristics including a quick response and a wide viewing angle, and the element itself is solid, so that it has an advantage that it can be applied to flexible usage.

To drive the organic EL display apparatus, PM (passive matrix) drive and AM (active matrix) drive can be employed in the same manner as the LCD, but the AM drive method, which provides the individual pixels with a thin-film transistor (TFT) to separately control them, is the mainstream. Thus, the provision of high definition, long life and lower power consumption is also taken into consideration.

To control the emission of light by each pixel of the organic EL display apparatus without involving variation, it is necessary to provide the same current value to the individual pixels for a prescribed image signal. Especially, such control is important for a method that the image signal is given as an analog signal and the pixels are caused to emit an intermediate light according to its analog value. Examples of a display apparatus, which is intended to reduce luminance variation, include the following patent literatures 1 and 2.

The organic EL display apparatus disclosed in the patent literature 1 has a structure to perform negative feedback such that the pixel current corresponds to the image signal. Thus, even if a current control circuit has variations in an input voltage vs. output current characteristic, such variations are absorbed, and the pixels are provided with the same current value with respect to a prescribed image signal. The display apparatus of the patent literature 2 is disclosed having a structure that the light emitted from the light emitting section is detected by a photodiode and fed back to the image signal. Thus, it is conceivable that the substantially the same effects can be obtained.

[Patent Document 1] Japanese Patent Laid-Open Application No. 2002-91377

[Patent Document 2] Japanese Patent Laid-Open Application No. 2003-271098

But, the structure disclosed in the patent literature 1 might have a disadvantage in view of an aperture ratio (a ratio of the net area of the light emitting section to the display area) of the display because it is essentially necessary to form an error amplifying circuit, which is required for negative feedback, on the individual pixels. And, it is conceivable that the structure disclosed in the patent literature 2 is inevitably complex because a reset circuit and a reset signal path are required to obtain the above-described feedback signal.

SUMMARY

Under the circumstances described above, the present invention provides an organic EL display apparatus in which a self-emission organic EL (electroluminescence) element is used for each pixel and disposed in a matrix form, which reduces luminance variation of each pixel by its simple structure and can reduce the lowering of the aperture ratio to a small level.

According to an aspect of the present invention, there is provided an organic EL display apparatus which has plural pixels arranged in a matrix form, selects pixels from the plural pixels according to a pixel selection signal and causes the selected pixels to emit light according to an image signal, comprising a light emitting section; a current control section which controls a current to be flown to the light emitting section; a photoelectric converting section which generates a current upon detecting light emitted from the light emitting section; a first switching section which switches between transmission and non-transmission of the current generated according to the pixel selection signal; an amplifying section which performs current-voltage conversion of the current transmitted by the first switching section and amplifies it; a comparison amplifying section which performs comparison and amplification of a voltage value obtained by the amplification and a voltage value corresponding to the image signal; a second switching section which switches between transmission and non-transmission of the voltage value resulting from the comparison and amplification according to the pixel selection signal; and an image signal holding capacitor which is charged or discharged according to the voltage value transmitted by the second switching section, wherein the current control section controls the current to be flown to the light emitting section according to the charging voltage of the image signal holding capacitor.

By configuring as described above, the image signal is input to one end of the comparison amplifying sections, while a voltage obtained by current-voltage conversion and amplification of a current generated by the photoelectric converting section is given to the other input via the first switching section. Further, the output from the comparison amplifying section is supplied to the image signal holding capacitor and the current control section via the second switching section. In this structure, it is easy to achieve the use of the first switching section of the individual pixels for the multiplexer and the second switching section of the individual pixels for the demultiplexer. In other words, one comparison amplifying section is enough for the plural pixels, so that it is not necessary to dispose the comparison amplifying section for each of the pixels. Thus, the cause of lowering the aperture ratio can be eliminated. Further, the negative feedback is made by the comparison amplifying section from the light emitting section via the photoelectric converting section and the amplifying section. Therefore, even if the input voltage vs. output current characteristic of the current control section is variable, it is absorbed, and the same current value can be obtained for the pixels with respect to a prescribed image signal.

According to the organic EL display apparatus of an aspect of the present invention, it has the comparison amplifying section for the negative feedback but does not need the provision of the comparison amplifying section for the individual pixels. Further, it does not need a reset circuit, reduces luminance variation of each pixel by its simple structure, and can reduce the lowering of the aperture ratio to a small level.

DETAILED DESCRIPTION

Description of Examples

Figure 1:
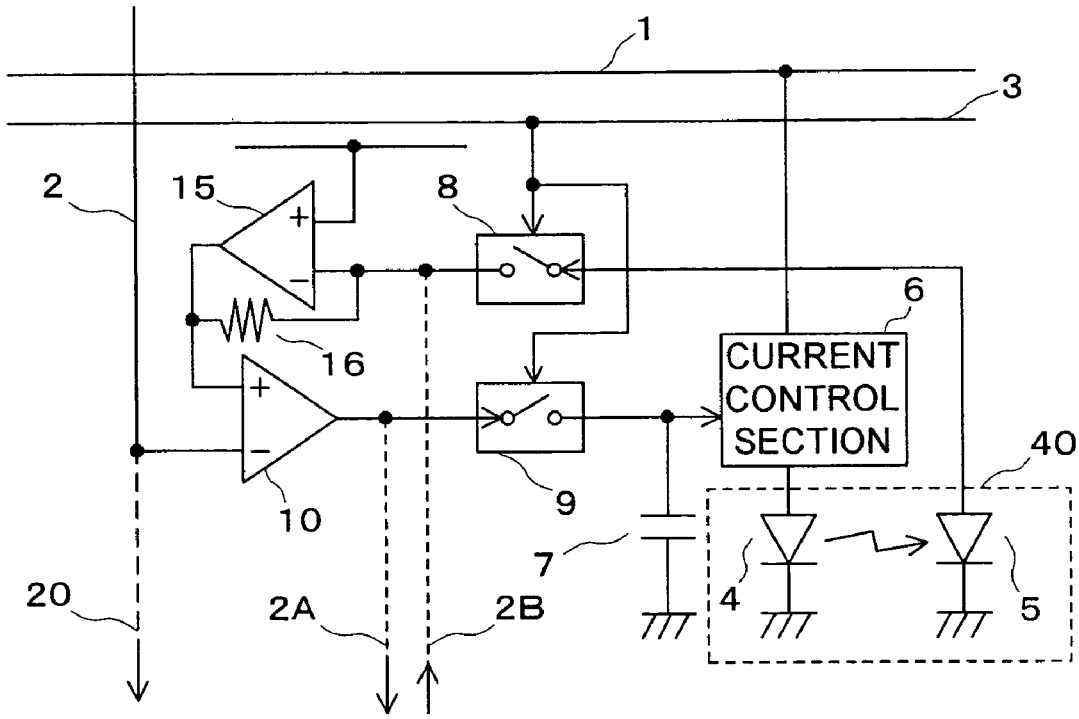
FIG. 1 is a block view showing a structure of a particular pixel in the organic EL display apparatus according to one embodiment of the present invention.

Embodiments of the present invention will be described with reference to the drawings, which are provided for illustration only and do not limit the present invention in any respect.

As a form of an embodiment of the present invention, it can be configured that the light emitting section and the photoelectric converting section have a common layer for conducting light emission and photoelectric conversion and a common cathode electrode which is laminated on one side of the common layer, the light emitting section also has a light emitting section anode electrode which is laminated on the other side of the common layer, and the photoelectric converting section also has a photoelectric converting section anode electrode which is laminated on the other side of the common layer and at a position adjacent to the light emitting section anode electrode. This is one example of ensuring consistency between the light emitting section formed with ground as reference and the photoelectric converting section formed in view of the structure. By configuring in this way, optical coupling between the light emitting section and the photoelectric converting section can be realized for the individual pixels with ease.

As a form of an embodiment, the light emitting section, the current control section, the photoelectric converting section, the first switching section, the second switching section, and the image signal holding capacitor are disposed for each on each of the plural pixels, the amplifying section and the comparison amplifying section each are disposed on each column of pixels in the matrix form, the connection from the first switching section to the amplifying section is made from all the pixels contained in the column of pixels to which the comparison amplifying section belongs, and the connection from the comparison amplifying section to the second switching section is made on all the pixels contained in the column of pixels to which the comparison amplifying section belongs.

It is a structure having the above-described first and second switching sections used as a multiplexer or a demultiplexer on each column of the pixels in a matrix form. Thus, the amplifying section and the comparison amplifying section one each are enough for each column, and the number of the amplifying section and the comparison amplifier to be built in can be minimized.

Further, a form of an embodiment is configured such that the current control section is an n channel thin-film transistor and outputs the current to be flown to the light emitting section as a drain-source current, and the current is controlled by the charging voltage of the image signal holding capacitor supplied to a gate. In this structure, the n channel thin-film transistor is used for the current control section.

A form of an embodiment is also configured such that the current control section is a p channel thin-film transistor and outputs the current to be flown to the light emitting section as a source-drain current, and the current is controlled by the charging voltage of the image signal holding capacitor supplied to the gate. In this structure, the p channel thin-film transistor is used for the current control section.

Figure 7A:
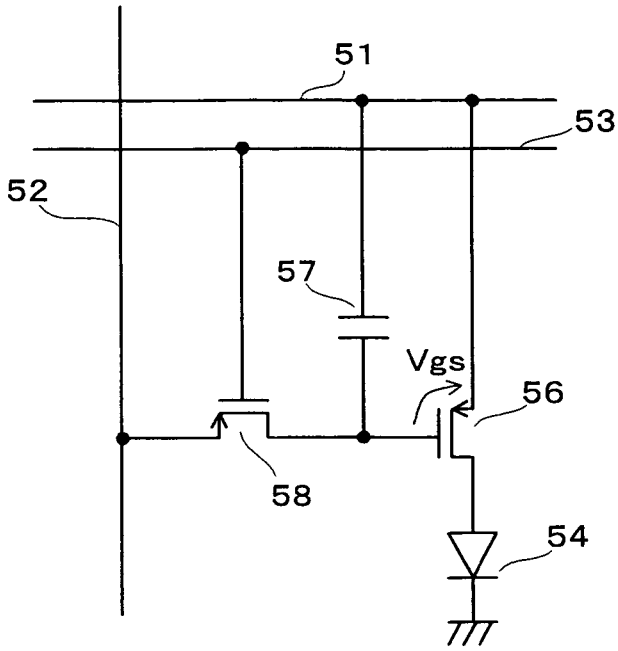
FIG. 7A and FIG. 7B are equivalent circuit diagrams each showing a structure of a pixel of an organic EL display apparatus as a comparative example.
Figure 7B:
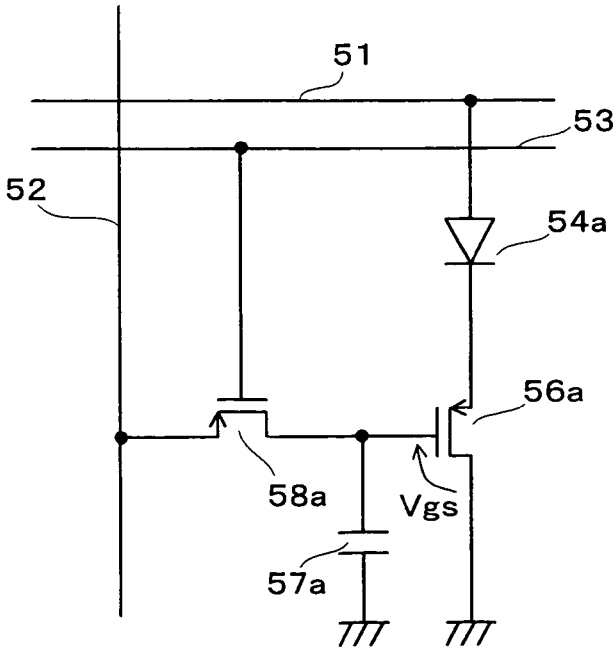

Under the circumstances described above, embodiments of the present invention will be described below with reference to the drawings. First, prior to the explanation of the embodiments, a cause of the generation of uneven luminance in the individual pixels of the organic EL display apparatus will be described with reference to FIG. 7A and FIG. 7B. FIG. 7A and FIG. 7B are equivalent circuit diagrams each showing a structure of each pixel of the organic EL display apparatus as comparative examples. FIG. 7A shows a structure using p channel transistors 56, 58 as thin-film transistors (TFTs), and FIG. 7B shows a structure using n channel transistors 56*a*58*a* as thin-film transistors.

It is shown in FIG. 7A that an organic EL element 54 as a light emitting section is formed with a ground as reference, while it is shown in FIG. 7B that an organic EL element 54*a* is formed with a power source as reference. Reference numerals 57, 57*a* denote image signal holding capacitors, reference numeral 51 denotes a power wire, reference numeral 52 denotes an image signal line, and reference numeral 53 denotes a scanning line. It is not shown but the image signal line 52 is commonly connected to other pixels in a longitudinal (column) direction, and the scanning line 53 is commonly connected to other pixels in a latitudinal (row) direction.

To the image signal line 52 is supplied an image signal with an analog value (voltage), and a pixel selection signal is synchronously supplied to the scanning line 53. When the pixel selection signal is supplied to the scanning line 53, the transistor 58 (58*a*) is brought into a conductive state, and the image signal holding capacitor 57 (57*a*) is charged or discharged according to the voltage of the image signal on the image signal line 52. The capacitor 57 (57*a*) keeps that voltage until the transistor 58 (58*a*) is brought into a conductive state next time. The transistor 56 (56*a*) controls the drain current by the voltage held by the capacitor 57 (57*a*).

Here, an input voltage (gate source-to-gate source voltage Vgs.) vs. output current (drain current Ids, particularly a source-drain current for the p channel transistor 56 considering a current direction, and also a drain-source current for the n channel transistor 56*a*) characteristic of the transistor 56 (56*a*) is represented by the following expression. Specifically, it is $Ids=(1/2)\cdot\mu\cdot Cox\cdot(W/L)\cdot(Vgs-Vth)^2$. Here, μ denotes a carrier mobility, Cox denotes a gate capacitance per unit area, W denotes a channel width, L denotes a channel length, and Vth denotes a threshold voltage. It is apparent from the expression that if the threshold voltage Vth is variable depending on the individual pixels, the output current (drain current Ids) with respect to the same input voltage (gate source-to-gate source voltage Vgs) is variable because of a square characteristic (namely, very high sensitivity). The drain current Ids is a current to be flown as it is to the organic EL element 54 (54*a*), causing current variations, namely luminance variations.

For the TFT as the transistor 56 (56*a*), polysilicon having remarkable current drive ability is often used as its channel material, but as a characteristic of the element, the threshold voltage Vth varies actually by, for example, about a few tens of mV. Therefore, the structures of these comparative examples cannot avoid luminance variations of each of the pixels as the display apparatus. Further, when it is designed to reduce the center value of Vth in order to reduce the variations of the drain current Ids, the drain current Ids becomes large, and the power consumption of the organic EL display apparatus cannot be reduced. Thus, it is not desirable.

Meanwhile, FIG. 1 is a block view showing a structure of a prescribed pixel of the organic EL display apparatus according to one embodiment of the present invention. As shown in FIG. 1, to this pixel are connected a power line 1, an image signal line 2 and a scanning line 3. This pixel has a light emitting section 4, a photoelectric converting section 5, a current control section 6, an image signal holding capacitor 7, a first switching section 8, a second switching section 9, a comparison amplifying section 10, an operational amplifying circuit 15.and a resistor 16. The light emitting section 4 and the photoelectric converting section 5 are optically coupled and function as an optical coupling section 40. The operational amplifying circuit 15 and the resistor 16 function as a current input type amplifying circuit (amplifying section). It is not shown in the drawing but the scanning line 3 is commonly connected to other pixels in a horizontal (row) direction.

The light emitting section 4 is an organic EL element which is formed with a ground as reference, and its anode side is connected to the current output terminal of the current control section 6. The current control section 6 controls the current flowing to the light emitting section 4, and the control input terminal of the current control section 6 is connected to one end of the capacitor 7 such that its control complies with the voltage held by the voltage holding capacitor 7. The photoelectric converting section 5 is connected between a ground and one end of the first switching section 8, detects light emitted from the light emitting section 4 according to the current controlled by the current control section 6 and performs photoelectric conversion depending on an amount of light, thereby generating a current. The generated current is guided to the current input type operational amplifying circuit (configured of the operational amplifying circuit 15 and the resistor 16) via the first switching section 8.

The first switching section 8 is disposed between the photoelectric converting section 5 and the inverting input terminal of the operational amplifying circuit 15, performs switching of transmission/non-transmission according to a pixel selection signal from the scanning line 3 and guides the current generated by the photoelectric converting section 5 to the inverting input terminal of the operational amplifying circuit 15 at the time of transmitting. The second switching section 9 is disposed between the output of the comparison amplifying section 10, and one end of the image signal holding capacitor 7 and the control input terminal of the current control section 6. The second switching section 9 performs switching of transmission/non-transmission according to the pixel selection signal from the scanning line 3 and guides the output voltage from the comparison amplifying section 10 to one end of the image signal holding capacitor 7 and the control input terminal of the current control section 6 at the time of transmitting.

The operational amplifying circuit 15 configures the amplifying section together with the resistor 16, a constant voltage (e.g., −5V) is give to its non-inverting input terminal, and the generation current of the photoelectric converting section 5 is guided as input current to the inverting input terminal via the first switching section 8. The resistor 16 is connected between the output terminal of the operational amplifying circuit 15 and the inverting input terminal, and a voltage after a prescribed current-voltage amplification is generated at the output terminal of the operational amplifying circuit 15. The generated output voltage is guided to the non-inverting input terminal of the comparison amplifying section 10.

The comparison amplifying section 10 has a function of subtracting the voltage of the inverting input terminal from the voltage of the non-inverting input terminal and amplifying the result with a large gain to output. The inverting input terminal is connected to the output terminal of the operational amplifying circuit 15 as described above, the output terminal is connected to the second switching section 9 as described above, and the image signal is supplied from the image signal line 2 to its non-inverting input terminal. A broken line 2B which is drawn to join the inverting input terminal of the operational amplifying circuit 15, a broken line 2A which is drawn to extend from the output of the comparison amplifier 10 and a long broken line 20 which is drawn to extend from the image signal line 2 will be described later.

According to the pixel of the organic EL display apparatus configured as shown in FIG. 1, an image signal is given to the image signal line 2, a pixel selection signal is given to the scanning line 3, the first and second switching sections 8, 9 are closed, and a voltage substantially equal to the image signal becomes the output voltage of the operational amplifying circuit 15. It is because a negative feedback path is formed of a loop of the photoelectric converting section 5, the first switching section 8, the amplifying section (the operational amplifying circuit 15 and the resistor 16), the comparison amplifying section 10, the second switching section 9, the current control section 6 and the photoelectric converting section 5, and a relationship between the non-inverting input and the inverting input of the comparison amplifying section 10 becomes a so-called imaginary short-circuit state.

Thus, the generation current of the photoelectric converting section 5 has a value corresponding to the image signal given to the image signal line 2, and the generation current is based on the amount of light which is emitted from the light emitting section 4 and detected. As a result, the amount of light emitted from the light emitting section 4 has a value corresponding to the image signal given to the image signal line 2. In other words, it may be said that, when it is assumed that the photoelectric conversion by the optical coupling section 40 which is comprised of the light emitting section 4 and the photoelectric converting section 5 is detection of the current flowing through the light emitting section 4 by means of light, variations in the current flowing through the light emitting section 4 is eliminated in principle due to the negative feedback. Therefore, luminance variation of each pixel is eliminated. A voltage which makes the current value of the light emitting section 4 constant is generated in the image signal holding capacitor 7 by above-described negative feedback path regardless of variations in the input voltage vs. output current characteristic of the current control section 6.

As a display apparatus, the easiest structure has the pixels with the above-described configuration arranged in longitudinal (column) and latitudinal (row) directions. In this case, the image signal line 2 is extended as indicated by the long broken line 20 so as to be commonly connected to other pixels in the longitudinal (column) direction. A conducting wire corresponding to the broken lines 2A, 2B is not disposed. But, it is disadvantageous in terms of the aperture ratio (a ratio of the net area of the light emitting section to the display area)

because it is necessary to dispose and incorporate the comparison amplifying section 10, the operational amplifying circuit 15 and the resistor 16 in addition to the first and second switching sections 8, 9 for each of the pixels.

Therefore, a structure not requiring disposing the comparison amplifying section 10, the operational amplifying circuit 15 and the resistor 16 on the individual pixels can also be conceived. In such a structure, the broken line 2B which is drawn to join the inverting input terminal of the operational amplifying circuit 15 and the broken line 2A which is drawn to extend from the output of the comparison amplifier 10 are disposed as the conducting wires, and the conductive wires are commonly connected to the individual pixels in the column direction. A conducting wire corresponding to the long broken line 20 is not disposed. Unshown individual pixels, to which the broken lines 2B, 2A are connected, are not provided with the comparison amplifying section 10, the operational amplifying circuit 15 and the resistor 16.

According to such a structure, the first switching section 8 becomes a multiplexer which selects the output of the photoelectric converting section 5 of the individual pixels in the column direction, and the second switching section 9 becomes a demultiplexer which distributes the output of the comparison amplifying section 10 to the image signal holding capacitor 7 of the individual pixels in the column direction. Such selection and distribution are performed according to the pixel selection signal given to the scanning line 3. By configuring as described above, the comparison amplifier 10, the operational amplifying circuit 15 and the resistor 16 are sufficient when disposed on at least one each in the individual columns, and necessity of incorporating on the display surface of the display apparatus can be eliminated, so that a large effect of increasing the aperture ratio can be obtained. A structure in that each of them is not disposed on the individual columns but disposed on each pixel of the plural rows of the individual columns can also be adopted.

The amplifying section comprised of the operational amplifying circuit 15 and the resistor 16 is a current-voltage conversion type amplifier and advisably has a function to amplify a very week current generated by the photoelectric converting section 5 by the voltage value output, so that a structure other than the above use of the operational amplifying circuit can also be adopted. For example, there can be provided a simple structure in that the current generated by the photoelectric converting section 5 is flown to a resistor of which one end is connected to a constant voltage via the first switching section 8 and the voltage generated at the other end of the resistor is a determined as the output voltage. But, it is necessary to pay attention to a situation that an effect of a parasitic capacitance might not be neglected because a resistance value becomes large to secure a sufficient amplification degree. If a parasitic capacitance occurs, a frequency characteristic as a circuit is deteriorated, and a desired operation speed cannot be obtained.

Figure 2:
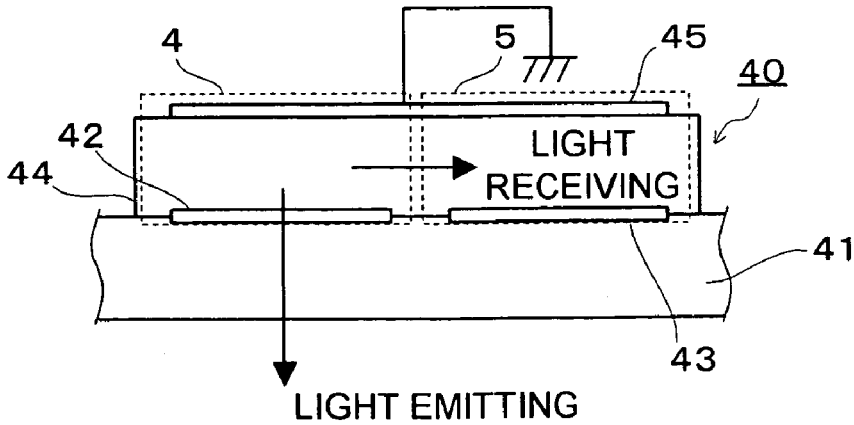
FIG. 2 is a sectional view schematically showing a structure of the light emitting section and the photoelectric converting section shown in FIG. 1.

FIG. 2 is a sectional view schematically showing the structure of the optical coupling section 40 which is comprised of the light emitting section 4 and the photoelectric converting section 5 shown in FIG. 1. In FIG. 2, the same reference numerals are allotted to the same elements as those shown in FIG. 1. As shown in FIG. 2, the light emitting section 4 and the photoelectric converting section 5 can be formed adjacent to each other on the same glass substrate 41.

The light emitting section 4 is composed of a light emitting section anode electrode 42 which is formed as a layer on the glass substrate 41, an organic EL layer 44 which is laminated on the light emitting section anode electrode 42, and a common cathode electrode 45 which is laminated on the organic EL layer 44. The photoelectric converting section 5 is composed of a photoelectric converting section anode electrode 43 which is formed as a layer on the glass substrate 41, the organic EL layer 44 which is laminated on the photoelectric converting section anode electrode 43, and the common cathode electrode 45 which is laminated on the organic EL layer 44. In other words, the light emitting section 4 and the photoelectric converting section 5 are different in the anode electrode only and have the glass substrate 41, the organic EL layer 44 and the common cathode electrode 45 in common. Therefore, they have very good consistency with each other in view of the structure. To the common cathode electrode 45 is applied a ground level voltage as apparent from FIG. 1.

Light emitted from the light emitting section 4 travels partly in the direction of the glass substrate 41 as shown in the drawing and makes direct light emission of the display apparatus. Meanwhile, the other portion of the light travels in the layer direction within the organic EL layer 44 and is received by the organic EL layer 44 of the photoelectric converting section 5 and detected. Generally, it is known that a ratio of the light traveling in the layer direction within the organic EL layer 44 is larger than a ratio of light traveling in the direction of the glass substrate 41 in the light emitted from the light emitting section 4. FIG. 2 shows that the plane area of the light emitting section 4 and that of the photoelectric converting section 5 have a similar size, but the photoelectric converting section 5 may be formed to be smaller considering an aperture ratio in view of practical use.

As shown in FIG. 2, the light emitting section 4 and the photoelectric converting section 5 can be formed to have a very close optically-coupled structure. In other words, the photoelectric converting section 5 can have a function to detect the current flowing through the light emitting section 4 with high accuracy by the medium of light.

Figure 3:
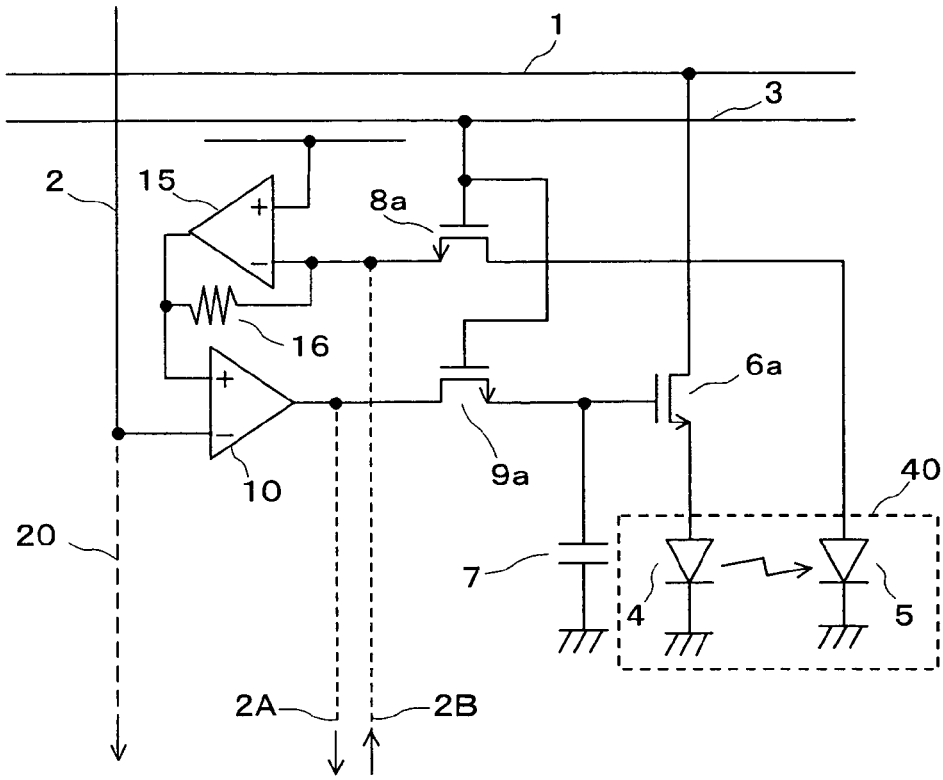
FIG. 3 is a circuit diagram showing an example of applying a specific element to the individual blocks in the embodiment shown as the block view in FIG. 1.

FIG. 3 is a circuit diagram showing an example of applying a specific element to each block in the embodiment shown as the block view in FIG. 1. In FIG. 3, the same reference numerals are allotted to the same elements as those shown in FIG. 1. In this case, n channel transistors 6*a*, 8*a*, 9*a* are used as the current control section 6, the first switching section 8 and the second switching section 9. The transistors 6*a*, 8*a*, 9*a* can be thin-film MOS transistors formed on the glass substrate as known well. Especially, they can be transistors of amorphous silicon.

The connection of the n channel transistors 6*a*, 8*a*, 9*a* is additionally described below. The transistor 6*a* has a source connected to the anode of the light emitting section 4 and a drain connected to the power line 1. In addition, a gate is connected to one end of the image signal holding capacitor 7. The transistor 8*a* has the gate connected to the scanning line 3, the drain connected to one end of the photoelectric converting section 5 and the source connected to the inverting input terminal of the operational amplifying circuit 15. The transistor 9*a* has the gate connected to the scanning line 3, the drain connected to the output of the comparison amplifying section 10 and the source connected to one end of the image signal holding capacitor 7. The transistors 8*a*, 9*a* can have the source and the drain reversed because they perform a switching operation.

Figure 4:
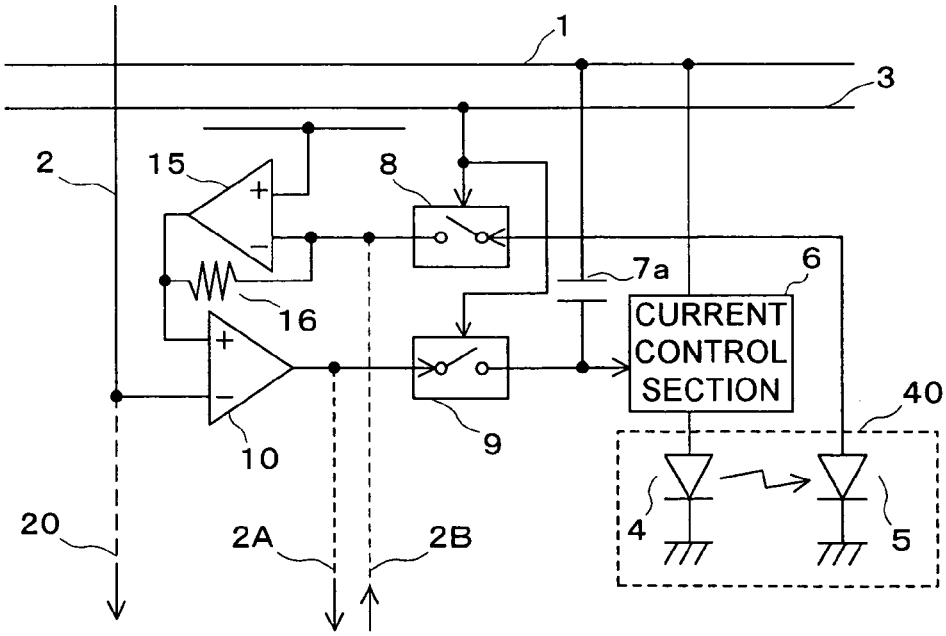
FIG. 4 is a block view showing a structure of a particular pixel in the organic EL display apparatus according to another embodiment of the present invention.

FIG. 4 is a block view showing the structure of a particular pixel in the organic EL display apparatus according to another embodiment of the present invention. In FIG. 4, the same reference numerals are allotted to the same elements as those already described above and the description on them is omitted. In this embodiment, which is different from the embodiment shown in FIG. 1, the other end of the image signal holding capacitor 7*a* is not connected to the ground but to the power line 1. This difference between the capacitor 7 and the capacitor 7*a* does not cause an operational difference in the pixels.

Figure 5:
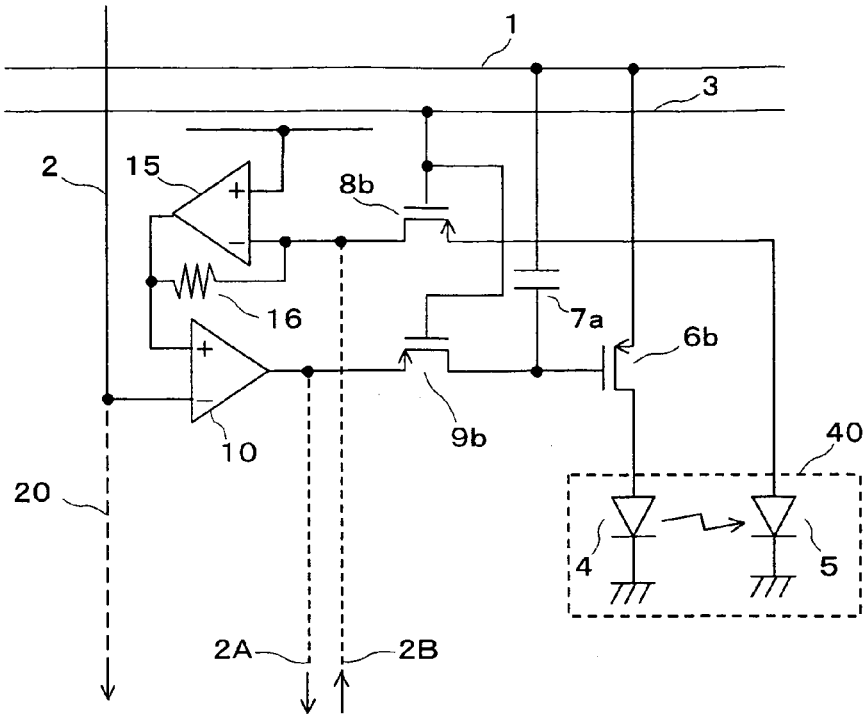
FIG. 5 is a circuit diagram showing an example of applying a specific element to the individual blocks in the embodiment shown as the block view in FIG. 4.

FIG. 5 is a circuit diagram showing an example of applying a specific element to each block in the embodiment shown as the block view in FIG. 4. In FIG. 5, the same reference numerals are allotted to the same elements as those shown in FIG. 4. In this case, p channel transistors 6*b*, 8*b*, 9*b* are used as the current control section 6, the first switching section 8 and the second switching section 9. The transistors 6*b*, 8*b*, 9*b* can be thin-film MOS transistors formed on the glass substrate as known well. Especially, they can be transistors of amorphous silicon.

The connection of the p channel transistors 6*b*, 8*b*, 9*b* is additionally described below. The transistor 6*b* has the drain connected to the anode of the light emitting section 4 and the source connected to the power line 1. Further, it has the gate connected to one end of the image signal holding capacitor 7*a*. The transistor 8*b* has the gate connected to the scanning line 3, the source connected to one end of the photoelectric converting section 5 and the drain connected to the inverting input terminal of the operational amplifying circuit 15. The transistor 9*b* has the gate connected to the scanning line 3, the source connected to the output of the comparison amplifying section 10 and the drain connected to one end of the image signal holding capacitor 7*a*. The transistors 8*b*, 9*b* can have the source and the drain reversed because they perform a switching operation.

Figure 6:
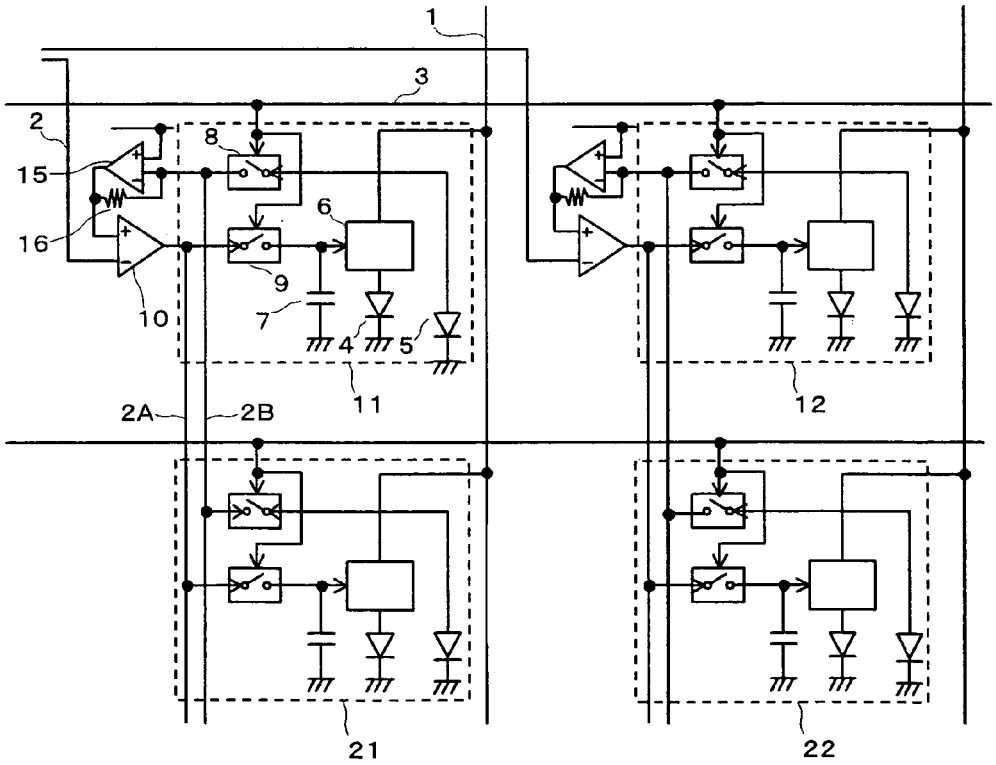
FIG. 6 is a view showing connections between a power wire 1, an image signal line 2 and a scanning line 3 and the individual pixels with the pixels having the structure shown in FIG. 1 used and disposed longitudinally and latitudinally.

FIG. 6 is a repetition of what is described above and a view showing the connection between the power line 1, the image signal line 2 and the scanning line 3, and the individual pixels when the pixels having the structure shown in FIG. 1 are used and disposed longitudinally and latitudinally. In FIG. 6, the same reference numerals are allotted to the same elements as those described above. As shown in FIG. 6, pixels 11, 12, . . . are disposed in a latitudinal (row) direction and the pixels 11, 21, . . . are disposed in a longitudinal (column) direction such that the pixels are arranged in a matrix form as a whole. It is easily apparent from the drawing that the comparison amplifying section 10, the operational amplifying circuit 15 and the resistor 16 are not required for each of the pixels.

It is to be understood that the present invention is not limited to the specific embodiments thereof illustrated herein, and various modifications may be made without deviating from the spirit and scope of the invention.

What is claimed is:

1. An organic EL display apparatus which has plural pixels arranged in a matrix form, selects a pixel from the plural pixels according to a pixel selection signal and causes the selected pixel to emit light according to an image signal, comprising:

a light emitting section;

a current control section which controls a current to be flown to the light emitting section;

a photoelectric converting section which generates a current upon detecting light emitted from the light emitting section;

a first switching section which switches between transmission and non-transmission of the current generated according to the pixel selection signal;

an amplifying section which performs current-voltage conversion of the current transmitted by the first switching section and amplifies the current transmitted;

a comparison amplifying section which performs comparison and amplification of a voltage value obtained by the amplification and a voltage value corresponding to the image signal;

a second switching section which switches between transmission and non-transmission of the voltage value resulting from the comparison and amplification according to the pixel selection signal; and an image signal holding capacitor which is charged or discharged according to the voltage value transmitted by the second switching section, wherein the current control section controls the current to be flown to the light emitting section according to the charging voltage of the image signal holding capacitor.

2. An organic EL display apparatus according to claim 1, wherein the light emitting section and the photoelectric converting section have a common layer which performs light emission and photoelectric conversion and a common cathode electrode which is laminated on one side of the common layer;

wherein the light emitting section has a light emitting section anode electrode which is laminated on the other side of the common layer; and wherein the photoelectric converting section has a photoelectric converting section anode electrode which is laminated on the other side of the common layer and at a position adjacent to the light emitting section anode electrode.

3. An organic EL display apparatus according to claim 1, wherein the light emitting section, the current control section, the photoelectric converting section, the first switching section, the second switching section and the image signal holding capacitor are disposed on each of the plural pixels;

wherein the amplifying section and the comparison amplifying section each are disposed on each column of the pixels in the matrix form;

wherein connection from the first switching section to the amplifying section is made by all pixels contained in the column of pixels to which the comparison amplifying section belongs; and wherein connection from the comparison amplifying section to the second switching section is made on all the pixels contained in the column of pixels to which the comparison amplifying section belongs.

4. An organic EL display apparatus according to claim 1, wherein the current control section is an n channel thin-film transistor and outputs the current to be flown to the light emitting section as a drain-source current, and the drain-source current is controlled by the charging voltage of the image signal holding capacitor supplied to a gate.

5. An organic EL display apparatus according to claim 1, wherein the current control section is a p channel thin-film transistor and outputs the current to be flown to the light emitting section as a source-drain current, and the source-drain current is controlled by the charging voltage of the image signal holding capacitor supplied to a gate.

6. An organic EL display apparatus according to claim 4, wherein the current control section is an amorphous silicon thin-film transistor.

7. An organic EL display apparatus according to claim 5, wherein the current control section is an amorphous silicon thin-film transistor.

* * * * *